United States Patent [19]

Catlett

[11] 4,045,914

[45] Sept. 6, 1977

[54] AUTOMATIC DOOR OPERATOR

[75] Inventor: John C. Catlett, Milwaukee, Wis.

[73] Assignee: The Stanley Works, New Britain, Conn.

[21] Appl. No.: 611,342

[22] Filed: Sept. 8, 1975

[51] Int. Cl.[2] ..... E05F 15/12

[52] U.S. Cl. ..... 49/334

[58] Field of Search ..... 49/138, 334, 264, 273, 49/274, 335, 340

[56] References Cited

U.S. PATENT DOCUMENTS

| | | | |
|---|---|---|---|
| 3,425,161 | 2/1969 | Catlett et al. | 49/340 X |
| 3,457,674 | 7/1969 | Catlett et al. | 49/264 X |

FOREIGN PATENT DOCUMENTS

| | | | |
|---|---|---|---|
| 143,992 | 7/1935 | Austria | 49/274 |

*Primary Examiner*—Philip C. Kannan
*Attorney, Agent, or Firm*—Ralph W. Kalish

[57] ABSTRACT

A door operator of electromechanical character for utilization with pivotally mounted doors, as by a center pivot, a butt hinge, or an offset pivot, comprising a prime mover, a driving shaft, adapted for rotation about a vertical axis and being secured through an arm to the door to be operated. A gear train interconnects said prime mover and said driving shaft wherein the gears are mounted as by a unique arrangement of needle roller and needle thrust bearings to permit said gear train to operate smoothly in door opening operation as a speed reducer and in door closing operation as a gear increaser. Energy storing means operatively connected to said driving shaft for storing energy during door opening operation and for energy releasing to drive said gear shaft during door closing operation. The said operator is adapted for compact disposition within the header of a door frame.

7 Claims, 5 Drawing Figures

AUTOMATIC DOOR OPERATOR

BACKGROUND AND SUMMARY OF THE INVENTION

This invention relates in general to door operating devices and, more particularly, to an electrically actuated door operator incorporating certain new and useful improvements in motion transmission.

It is an object of the present invention to provide a door operator of electro-mechanical character which is uniquely adapted for utilization with various types of doors, including those of the hinge or swinging type, that is whether of a center pivot, butt hinge, or offset pivot mounting.

It is another object of the present invention to provide a door operator of the character stated which is automatic in operation, being markedly compact and adapted for mounting disposition within the header portion of the door frame.

It is a further object of the present invention to provide an automatic door operator which may be utilized with existing door constructions without necessitating expensive modification and reconstruction.

It is a still further object of the present invention to provide an automatic door operator which incorporates a novel motion transmission system whereby rotary movement from a power source is operatively connected to a door pivot thereby obviating heretofore accepted complex and involved systems.

It is a further object of the present invention to provide an automatic door operator of the character stated wherein the motion transmission system is adapted for automatic disconnection in the event the door is subjected to forces tending to cause a rate of movement greater than that permitted by the normal operation of the motion transmission system.

It is a still further object of the present invention to provide an automatic door operator of the character stated which incorporates a uniquely designed gear train adapted to minimize the components necessary for power transmission as well as to effect a substantially noiseless operation.

It is a still further object of the present invention to provide an automatic door operator of the type stated which embodies a permanent magnetic-type motor adapted to effect dynamic breaking action upon door closing consequent to spring developed power.

It is a further object of the present invention to provide an automatic door operator of the character stated which may be most economically manufactured; the elements of which are designed for minimal friction thereby conducing to longevity of unimpaired operation; which is durable and reliable in usage; and which is extremely versatile in the door art being adapted for energization by any of innumerable remotely located control devices.

DESCRIPTION OF THE PREFERRED EMBODIMENT

Figure 1:
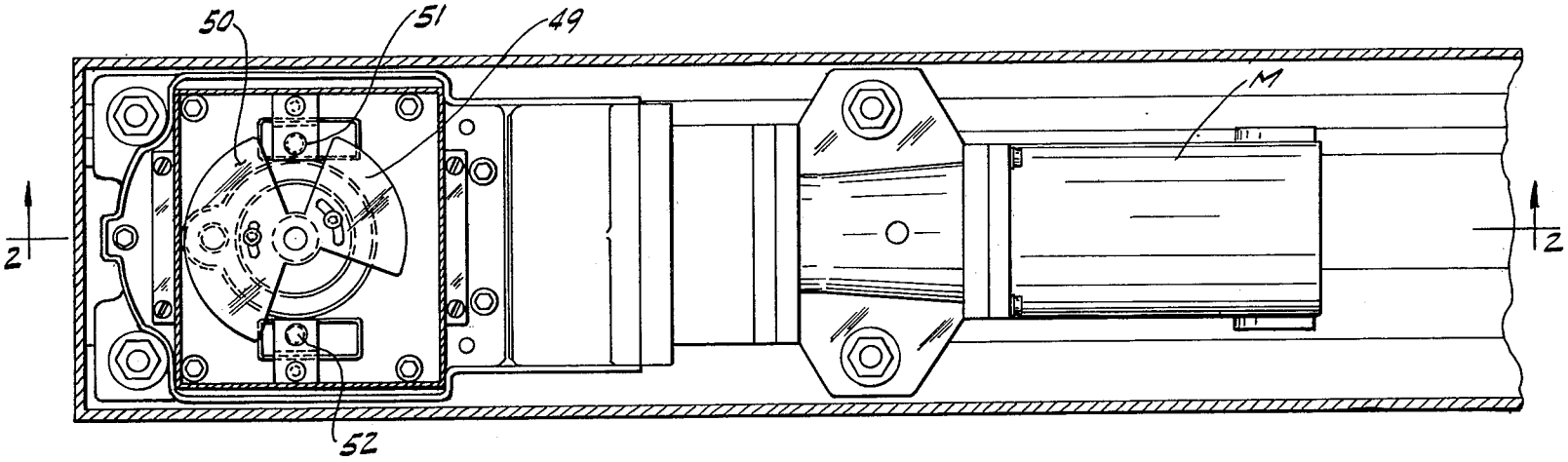
FIG. 1 is a top plan view in partial section of a door header containing a door operator constructed in accordance with and embodying the present invention, illustrating same in operative position.

Referring now by reference numerals to the drawings which illustrate the preferred embodiment of the present invention, A generally designates a door operator shown, for purposes of illustration, as mounted within the header or upper portion 1 of a door frame (not shown) as constituting the upper limit of a door opening indicated but broadly at 2; said header being shown as constituting an enclosed housing having a top wall 3, bottom wall 4, and end walls, as at 5. As will be indicated more fully hereinbelow, door operator A is of extreme versatility in usage, being adapted for operation with hinged or swinging-type doors, as well as balanced doors. For purposes of exposition only, operator A will be described in conjunction with a swingably door (not shown) which may be of the center pivot type and with there being a connecting arm 6 for interengaging operator A to the upper portion of the particular door (not shown). Door operator A incorporates a prime mover M of the direct current, shunt wound type, being provided with a permanent magnet (not shown) and which may be a singular circulate magnet surrounding the motor armature (not shown) or may comprise a plurality of circumferentially spaced magents disposed about the armature to provide a permanent magnet field for the motor in accordance with well known construction. Motor M is adapted for actuation by an electric switch located at a relatively remote point, such as for example only, through means of a switch-type floor mat, with there being the usual series of electrical relays (not shown) provided within an electrical control box (not shown) mounted in header 1. Consequently, the particular manner for energizing motor M does not form a part of the present invention since activation can be effected through any of numerous well known expedients, such as photoelectric cells, sonic switches, mechanical switching devices, and the like.

Figure 2:
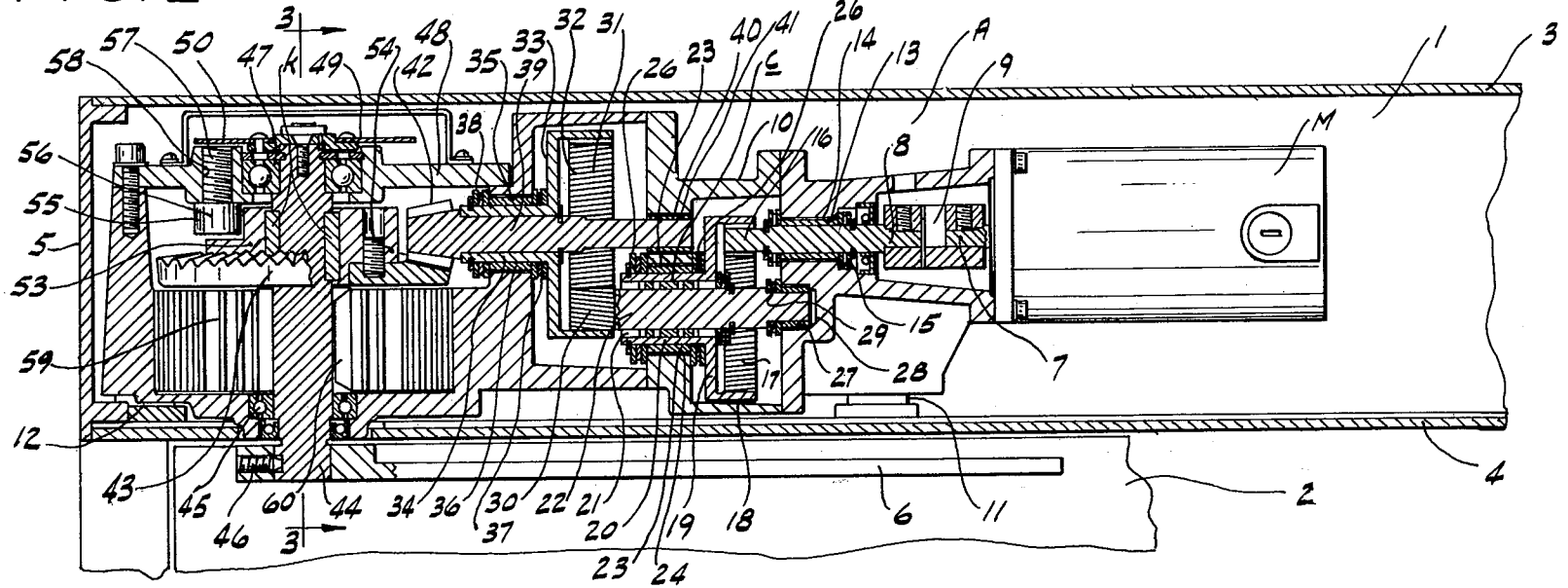
FIG. 2 is a vertical transverse sectional view taken on the line 2—2 of FIG. 1.
Figure 3:
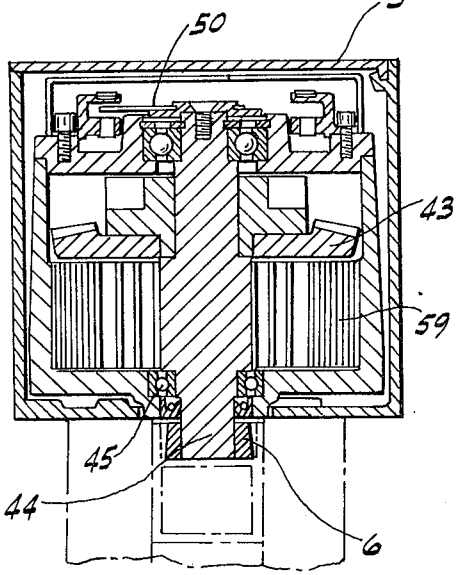
FIG. 3 is a vertical transverse sectional view taken on the line 3—3 of FIG. 2.

Motor M is provided with a main shaft 7 which is connected to a coaxial driven or input shaft 8 as by means of a coupling 9. It is to be recognized, however, that one end of a specially designed casing, referred to generally by the numeral 10, is fixed at one end upon motor M and suitably supported upon the base of header 1 by flexible mounts, as at 11, 12 for shock resistance; which casing 10 is uniquely designed to provide the requisite compartments and bearings for the components to be described hereinbelow. Input shaft 8 is journalled within roller type needle bearings 13 provided within a bore 14 in casing 10, with there being the customary thrust needle bearings and washers, as at 15, at either end of needle bearing 13. Said shaft 8 mounts a pinion 16 at its coupling remote end for meshing with the teeth 17 of an internal ring gear 18. With particular reference to FIG. 2, it is to be observed that the gear teeth of ring gear 18 are of helical character for coaction with pinion 16 whereby a substantially noiseless meshing is effected. Ring gear 18 incorporates an annular base 19 planarwise perpendicular to the longitudinal axis of header 1 and incorporates an integral central sleeve 20 within the bore of which is disposed the driving element 21 of an over-riding or over-running clutch, indicated generally *c*, which couples ring gear 18 with a shaft 22 about which said driving element is encirclingly disposed. Thus, sleeve 20 serves as the driven element of the clutch *c;* with there being a roller-type needle valve engaged about the central portion of said ring gear sleeve 20 within an opening 24 formed in a partition 25 within casing 10. Disposed about sleeve 20 in its portions at either side of partition 25 is a series of thrust needle bearings and thrust washers 26.

Shaft 22 in its prime mover remote end is journalled within a needle roller bearing 27 received within a bearing 28 formed in casing 10 and with there being the usual thrust needle bearings and washers, as at 29, mounted on said shaft 22 adjacent needle roller bearing 27. At its opposite end shaft 22 carries a pinion 30 meshing with the teeth 31 of a ring gear 32, said teeth 31 also being helically formed. Ring gear 32 also embodies a base 33 having a central sleeve or shank 34 which progresses through an enlarged bore 35 formed in the adjacent portion of casing 10 with there being a needle roller bearing 36 encircling said sleeve 34 within said bore 35 and with thrust needle bearings and washers, as at 37, 38, at opposite ends of said needle roller bearing 36. Said ring gear 32 is fixed, as by any suitable means, upon a gear shaft 39 which fittedly projects through sleeve 34. The end of shaft 39 proximate motor M is suitably journalled within a bearing 40 formed in casing 10 and with there being a needle roller bearing disposed thereabout, as at 41. The opposite end of said gear shaft 39 extends beyond the proximate end of sleeve 34 and integrally mounts a bevel driving gear 42 which meshes with a bevel gear 43 carried upon a main driving shaft 44, the axis of which is perpendicular to that of shaft 39 whereby the rotary motion generated by prime mover M has been directed through an angle of 90°.

Driving shaft 44 at its lower end is journalled within anti-friction bearings 45 fixed within the base of casing 10 and with the lower extremity of said shaft 44 continuing below bottom wall 4 for engagement as by a spline (not shown) and set screw 46 to connecting arm 6 which latter is hence directly rotatable with said driving shaft 44 so that as the latter rotates the respective door appropriately swings. In its upper end portion driving shaft 44 is similarly journalled within anti-friction bearings 47 as of the ball-type within a horizontally disposed cover component 48 of casing 10 and at its upper end extremity above said cover 48 there is mounted a pair of segmental switch-activating cams 49, 50 which are of different arcuate extent for cooperating with switches as of the photoelectric cell type 51, 52 which are suitably in circuit with prime mover M so as to control the opening and closing speeds of the particular door. It is understood that said switches 51, 52 are referred to merely for purposes of clarification and exposition as the same do not form a part of the present invention, being components of generally well known circuitry for the intended purpose.

Carried upon main driving shaft 44 immediately upwardly of bevel driven gear 43 is an annular detent 53 having a radially extending abutment portion 54 adapted, upon rotation of shaft 44, to be brought into movement arresting relationship with a stop element 55 constituting the depending head 56 of a bolt 57 threadedly received within a tapped opening 58 within cover component 48. It is, of course, apparent that detent 53 may be located with respect to shaft 44 so as to control the angle of travel before abutment 54 strikes stop member 55, but normally this angle is between 90 and 140° consonant with the particular arc of swing of the associated door.

Engaged upon driving shaft 44 between bevel driven gear 43 and the underlying base portion of casing 10 is a compression spring 59, one end of which, as at 60, is secured within shaft 44 and the other or outer end of which is rigid with the adjacent portion of casing 10. Thus, said spring 59 is concentric with driving shaft 44 so that upon rotation of the same during door opening operation the said spring will wind compressingly for storing of energy and upon travel of the door in the opposite direction, said stored energy will be released and spring 59 will rotate in the opposite direction, jointly with shaft 44.

Before describing the operation of door operator A, certain critical observations should be observed. The ratio between the various meshing gears will be determined by operational requirements and, therefore, there is no tendency to restrict the present invention to any specific ratio as within the gear train. However, for puposes of description and for normal application, it has been found that a ratio of approximately 5.75 to 1 between pinion 16 and ring gear 18; a ratio of approximately 5.2 to 1 between pinion 30 and ring gear 32; together with a ratio of approximately 5 to 1 between bevel driving gear 42 and bevel driven gear 43 have proved extremely effective. Also, the provision of the various needle roller bearings and needle thrust bearings has served to minimize friction, substantially eliminating any binding action so that the various shafts may rotate in either direction, for purposes to be shown, in an efficient manner whereby the inherent gear train can serve in one direction as a gear reducer and equally effectively as a gear increaser in the opposite direction. The various thrust bearings are preferably disc hardened steel with needle thrust bearings located between and while restraining the respective shafts against axial displacement, do not inhibit the desired rotatability brought about by the radial needle rollers. Thus, without said roller bearings and needle thrust bearings, considerable drag or sliding friction would be developed which would prevent the requisite smooth operation of door operator A.

In view of the foregoing it will be observed that upon energization of prime mover M with consequent rotation of drive shaft 7, rotation will be transmitted to bevel driving gear 42 through the intervening gear train as composed of ring gears 18 and 32, together with pinions 16 and 30 which gear train is comprised of a minimal number of components. Bevel driving gear 42 will thus cause rotation of driving shaft 44 by means of turning of bevel driven gear 43 with consequent compression of spring 59 thereabout with the development of substantial energy potential. Such rotative movement of driving shaft 44 will cause the related door to be swung into open condition by means of connecting arm 6 and with the door opening movement terminating by engagement between abutment 54 against stop member 55. It is, of course, understood that, as pointed out above, switch cams 49, 50, as the case may be, slows down the speed of motor M as the door approaches full open condition to avoid a jarring action. But with abutment 54 against stop 55, the motor will remain in a stalled condition, at a relatively low current and will remain in such state as long as the controlling switch, such as the switch mat, is in closed condition; with the same being caused by an individual remaining upon the mat. However, when the controlling switch is released, as be withdrawal of the individual from the switch mat for example, prime mover M is then de-energized. At this point the energy stored within spring 59 provides the motive force for returning the door to closed condition and by its releasing action causes driving shaft 44 to rotate in what might be considered the opposite or closing direction and thereby cause the gear train to operate in the opposite direction with a relatively substantial increase in speed due to the fact that the gear ratio is now effective in an opposite manner than during the door opening action. Thus, there will be a stepping up relationship with consequent increase in the speed of rotation of prime mover drive shaft 7 resulting in rotation of the motor armature (not shown) causing the motor to act as a dynamic brake. By rotation of the armature (not shown) prime mover M thus becomes a generator creating a braking resistance between the armature and the permanent magnetic field. The motor armature is connected to a closed electrical circuit (not shown) which includes variable resistors so that the closing speed may be increased or decreased by appropriate adjustment of such resistors, all in accordance with well known practice. Accordingly, it will be seen that in the door opening operation prime mover M serves as a motivating source for motion transmission through the above described gear train, while during the door closing operation compression spring 59 provides the requisite power for reverse transmission through said gear train.

Of critical importance to the reliable and durable operation of door operator A is over-riding clutch *c* as the same conduces to the smooth operation of said operator but serving primarily for efficient utilization when the associated door is operated manually, that is, without resort to the operator. Thus, when the related door is opened manually, as by a pulling upon a handle or a pushing against the door, clutch *c* over-rides the gear reduction and prime mover M. This same feature serves as a safety to the power equipment in the event that an individual should attempt to force the door to open more rapidly than the same would open during operation of operator A. Additionally, said over-riding clutch *c* protects the system against damage in the event the particular door is struck or forcibly knocked open, eliminating shock loads which might be built up through the gear reduction system through prime mover M.

Thus, at normal operating speeds, over-riding clutch *c* is locked when prime mover M is driving shaft 7 at normal operating speed, and it is also in locked condition when the prime mover M is being driven by the unstressing of spring 59 during door closing action. However, if an individual were to force the particular door to move more rapidly than would be encountered by motor operation in the opening action, clutch *c* slips and permits the door to be opened by disconnecting motor M and spring 59.

Although it does not form a part of the present invention, it should be recognized that the electrical system associated with door operator A may contain the customary "on" and "off" switch to permit cutting of power in the event it is desired to operate the door manually.

Figure 4:
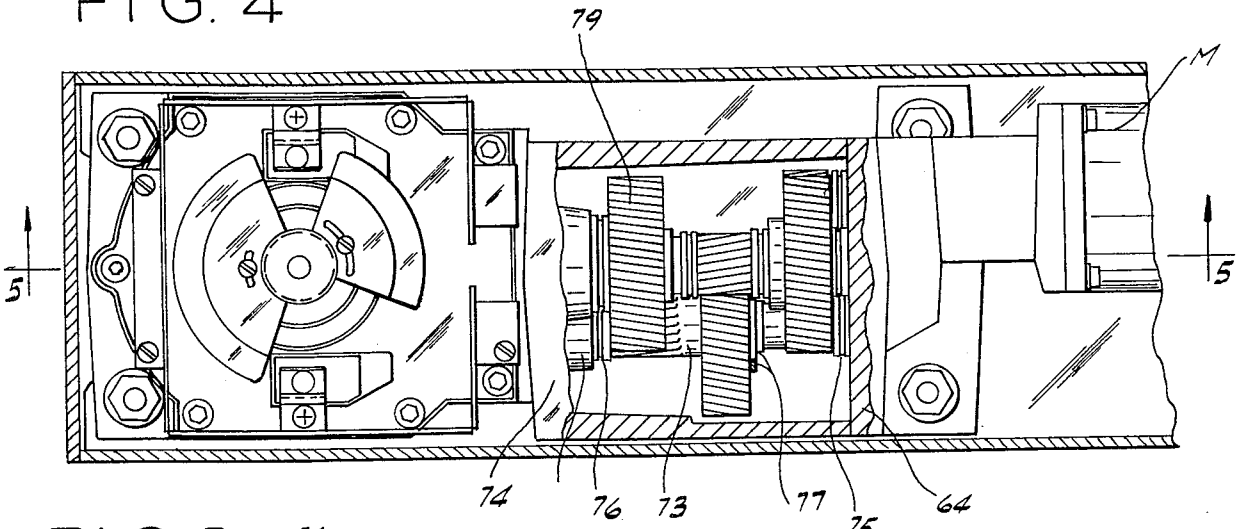
FIG. 4 is a top plan view of another form of automatic door operator constructed in accordance with and embodying the present invention, illustrating the same within the header of a door and with a portion of the header and the operator casing broken away.
Figure 5:
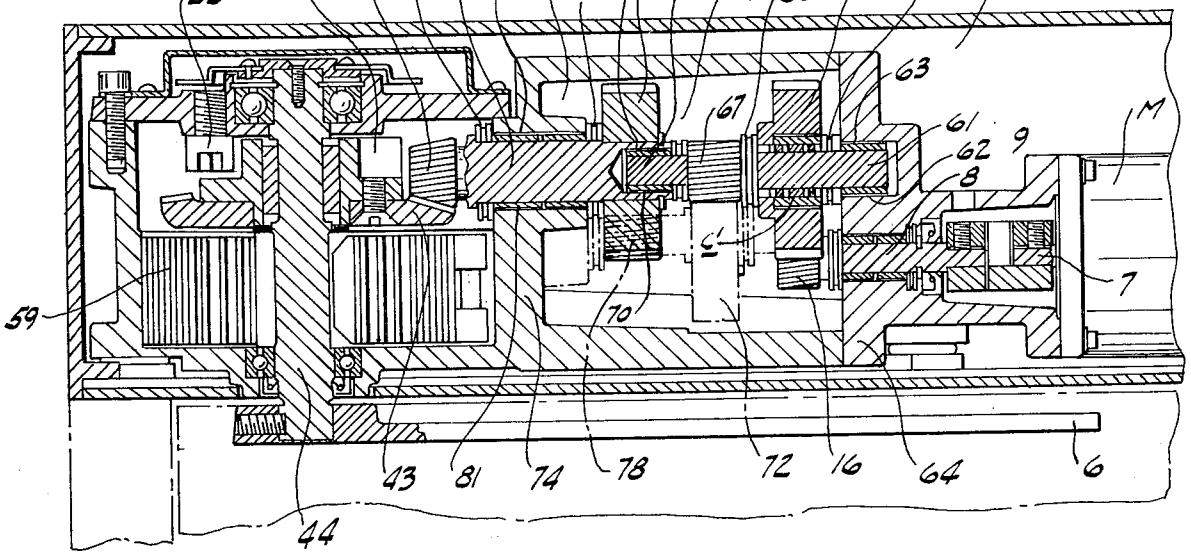
FIG. 5 is a vertical transverse sectional view taken on the line 5—5 of FIG. 4.

Referring now to FIGS. 4 and 5, another form of door operator, indicated generally A′, may be provided, if desired, which, in essence, fundamentally corresponds to door operator A, hereinabove described, with the exception that a novel gear train, indicated generally at G, is disposed between the prime mover and the driving shaft, comprising six gears as opposed to the basically four gear arrangement of door A above described. Door A′ is designed to accomplish the same purpose as door operator A but with the aforementioned structural modification. It will thus be appreciated that door operator A′ incorporates a multiplicity of components which are identical with corresponding components of door operator A as described so that like elements will bear like reference numerals for purposes of facilitating comprehension. Accordingly, pinion 16, which is the first gear in gear train G, carried at one end of input shaft 8 meshes with the lower portion of a relatively enlarged driven gear 60 which is coupled to a shaft 61 by an over-riding or over-running clutch *c′* which is in all respects structurally and functionally similar to clutch *c* described in connection with door operator A above. The prime mover proximate end of shaft 61 is accepted within a needle roller bearing 62 fitted within a bearing recess 63 formed in one end wall 64 of casing 10′ which latter, just as casing 10 above described, is contoured and constructed to accommodate the various components of door operator A′. Said wall 64 constitutes one end of a compartment 65 provided within said casing 10′ for receiving gear train G. Encirclingly mounted upon shaft 61 between wall 64 and driven gear 60 is a multiplicity of thrust needle bearings 66; with a similar set, as at 66′, on the opposite side of said gear 60. Immediately beyond thrust bearings 66′ shaft 61 incorporates a pinion 67 and with its proximate end 68 extending therebeyond for journalling within needle roller bearings 69 disposed within a bore 70 formed at the confronting end of an axially aligned bevel pinion shaft 71 to be described more fully momentarily. Said pinion 67 meshes with a gear 72 carried upon a shaft 73 suitably journalled at its ends within the rear wall 64 and forward wall 74 of compartment 65, thus extending lengthwise of said compartment 65 and having sets of thrust needle bearings 75, 76 at its ends proximate compartment wall 64, 74, respectively. Said gear 72 is secured preferably to shaft 73 by a key (not shown) held in one place by a shoulder on one side and retaining lock ring on the opposite side. Although not fully shown it is to be understood that gear 72 is disposed upon shaft 73 as by means of a keyway, at *k*, and with a retaining lock ring, as at 77, to inhibit any undesired displacement longitudinally of the shaft 73. In its end portion proximate compartment wall 74, shaft 73 integrally embodies a pinion 78 being thus the fifth gear in the six-gear train G which latter engages driven gear 79 suitably mounted upon bevel pinion gear shaft 71 radially outwardly of the interconnection of said shaft with shaft 68. Bevel pinion gear 71 continues through a bore 80 provided in compartment wall 74 being suitably encircled therein by needle roller bearings 81 and with thrust needle bearing grips 82, 83 at either end of bore 80 to retain said shaft 71 against longitudinal movement. At its end exterior of compartment 65, shaft 71 mounts a bevel driving gear 42 which is in meshing engagement with a bevel driven gear 43 carried upon a driving shaft 44; there being a compression spring 59 engaged about said driving shaft 44 all in the manner above described in conjunction with door operator A.

Thus, the remaining elements of door operator A′ are of like character and function as the corresponding components of door operator A so that repetitive description will be unnecessary.

From the foregoing it will be seen that gear train G accordingly transmits rotary motion from input shaft 8 to bevel driving gear 42 and with the gears constituting gear train G namely 16, 60, 67, 72, 78, 79 providing for a smooth transmission of motion with a predetermined speed increase based upon the selected ratios. Just as with door operator A, spring 59 is compressed during opening operation of the particular door associated with operator A' to thereby provide the requisite energy for driving gear train G in a reverse direction after power has been cut off to prime mover M as by the door user departing from the switch mat or otherwise releasing control of the particular switch. Thus, gear train G when transmitting motion from prime mover M to drive shaft 44 serves as a speed reducer and conversely when transmitting motion to the motor armature (not shown) through the power provided by the release of spring 59 acts as a speed increaser whereby prime motor M becomes a generator creating a braking resistance between its armature and its permanent magnetic field, all as above described in connection with door operator A. Over-riding clutch *c'* operates in the same manner as over-riding clutch *c* in door operator A, thereby protecting the operator against damage as fully described above. It is to be particularly noted that the unique arrangement of needle roller thrust bearings assure of smooth transmission between the various gears so that any undesired dragging or friction-producing condition is successfully avoided and with smooth operation of said operator A during both door opening and door closing conditions.

It should be understood that changes and modifications in the formation, construction, and arrangement and combination of the several parts of the automatic door operators may be made and substituted from those herein shown and described without departing from the nature and principle of the present invention.

Having described my invention, what I claim and desire to obtain by Letters Patents is:

1. A door operator for utilization with swing-mounted doors comprising a prime mover, a door driving shaft, means connecting said door driving shaft to the door to be operated thereby, means mounting said door driving shaft for rotation about its vertical axis, a drive shaft operatably engaged to said prime mover and having its longitudinal axis perpendicular to the axis of said door driving shaft, and transmission means connecting said prime mover drive shaft and said door driving shaft for operation of the latter into door opening condition pursuant to the power of the prime mover, said transmission means comprising an input shaft axially aligned with said drive shaft and operatably engaged thereto, a first driving gear carried on said input shaft, a first driven gear meshing with said first driving gear, a first shaft axially parallel to said input shaft, an over-riding clutch coupling said first driven gear and said first shaft, a second driving gear engaged upon said first shaft between the over-riding clutch and the end of said first shaft remote therefrom, a bevel pinion shaft axially aligned with said first shaft, means engaging said first shaft and said bevel pinion shaft in coaxial relationship, a second shaft axially parallel with said first shaft, a second driven gear carried on said second shaft between its ends and meshing with said second driving gear, a third driving gear carried on one end of said second shaft spacedly from said second driven gear, a third driven gear mounted on said bevel pinion shaft and meshing with said third driving gear, and cooperating bevel gear means operatively interconnecting said door driving shaft and said bevel pinion shaft at the end of the latter remote from said first shaft.

2. A door operator as defined in claim 1 and further characterized by said transmission means causing a speed reduction between said prime mover and said door driving shaft.

3. A door operator as defined in claim 2 and further characterized by said transmission means having a speed reduction between said prime mover and said door driving shaft in the order of approximately 5.75 to approximately 1.

4. A door operator as defined in claim 1 and further characterized by said means engaging said bevel pinion shaft and said first shaft comprising an end-opening bore formed in the end of said bevel pinion shaft confronting said first shaft and the proximate end of said first shaft being engaged within said bore, and said third driving gear being engaged upon said bevel pinion shaft radially outwardly of its engagement with said first shaft.

5. A door operator as defined in claim 1 and further characterized by means for limiting rotation of said door driving shaft in door opening operation.

6. A door operator as defined in claim 1 and further characterized by said gears of said transmission mean being journalled upon needle roller bearings for permitting freedom of rotation of said gears in either direction about their respective axes.

7. A door operator as defined in claim 6 and further characterized by a compression spring concentrically engaged about said driving shaft for energy storing compression during door opening operation through rotation of said door driving shaft and with said stored energy being released for transmission of motion from said door driving shaft to said prime mover upon de-energization of the latter for effecting door closing operation.

* * * * *